US005882745A

United States Patent [19]

Mi et al.

[11] Patent Number: 5,882,745

[45] Date of Patent: Mar. 16, 1999

[54] BAMBOO FIBER REINFORCED POLYPROPYLENE COMPOSITES

[75] Inventors: Yongli Mi, Saikung, China; Xiaoya Chen, Brooklyn, N.Y.; Qipeng Cuo, Hefei, China; Chi-Ming Chan, Kowloon, Hong Kong

[73] Assignee: The HongKong Univiersity of Science & Technology, Hong Kong, Hong Kong

[21] Appl. No.: 827,592

[22] Filed: Mar. 28, 1997

[51] Int. Cl.[6] ..... B27N 3/04

[52] U.S. Cl. ..... 428/15; 156/61; 428/17; 428/113

[58] Field of Search ..... 428/15, 17, 113; 442/388; 156/61

[56] References Cited

U.S. PATENT DOCUMENTS

| | | | |
|---|---|---|---|
| 4,340,513 | 7/1982 | Muteki et al. | 524/13 |
| 5,474,722 | 12/1995 | Woodhams | 264/45.5 X |
| 5,556,040 | 9/1996 | Irie et al. | 428/17 X |

*Primary Examiner*—Henry F. Epstein
*Attorney, Agent, or Firm*—Burns, Doane, Swecker & Mathis, L.L.P.

[57] ABSTRACT

There are disclosed novel composite materials in which polypropylene is reinforced by the inclusion of bamboo fibers. Preferably the polypropylene may be maleated prior to inclusion of the bamboo fibers in order to promote bonding between the bamboo fibers and the polypropylene matrix.

8 Claims, 7 Drawing Sheets

BAMBOO FIBER REINFORCED POLYPROPYLENE COMPOSITES

FIELD OF THE INVENTION

This invention relates to novel materials and in particular to polypropylene composite materials that are reinforced by bamboo fibers and which may be used as wood substitutes.

1. Background of the Invention

Wood remains today one of the most widely used materials in a variety of different applications. It is widely used, for example, in interior decoration and in the manufacture of furniture as well as a basic construction material for items as diverse as houses and boats.

As is well-known the worldwide demand for wood—in particular for high quality hardwoods—is so high that non-renewable logging of tropical hardwoods in many developing countries is causing serious concern. In addition to the significant environmental and ecological problems of such logging, as supplies dwindle and demand stays high costs will inevitably rise.

Timber substitutes in the form of wood fibreboard have been available for many years and have found a number of applications. However, such products are generally of mediocre mechanical performance and cannot meet the standards required for wide application in construction and industrial processes. There is therefore the need to develop high quality wood and timber substitutes.

2. Prior Art

In recent years bamboo has become a focus of interest. Bamboo has a number of advantages. Bamboo is an abundant natural resource in Asia and its overall mechanical properties are comparable to those of wood. Furthermore bamboo can be renewed much more rapidly than wood since the time required for bamboo to reach its mature size is only six to eight months, less than 5% of the time required for most woods.

A number of proposals have been made to incorporate bamboo as a reinforcement in a composite material. For example F. G. Shin, X. J. Xian and M. W. Yipp, *Proceedings of ICCM-VII*, 3, 469 (1989) investigated the mechanical properties and fracture mechanisms of bamboo-epoxy composites under different loading conditions. See also F. G. Shin and X. J. Xian, "Evaluation of Mechanical behaviour and Application of Bamboo Reinforced Plastic Composites", *Advances in Mechanics*, 19 (4). (1989) pp515–519 which compares the mechanical properties of various types of composites of different combinations of fiber phases and resins.

U. C. Jindal, Seema Jain, and Rakesh Kumar, "Development and Fracture Mechanism of the Bamboo/Polyester Resin Composite". *J. Mater. Sci. Lett.*, 12 (1993) pp558–560 and U. C. Jindal, Seema Jain, and Rakesh Kumar, "Mechanical Behaviour of Bamboo and Bamboo Composite", *J. Mater. Sci.*, 27 (1992) pp 4598–4604 discuss the development of bamboo-fiber-reinforced (BFR) plastic composites using a simple casting technique. Tests showed that the BFR plastic composites possessed ultimate tensile strength more or less equal to that of mild steel, whereas their density was only one eighth that of steel. Unfortunately, however, the impact strength of these composite materials was found to be poor.

In the prior art the composite materials involve a matrix of solid epoxy or polyester materials which are relatively expensive.

SUMMARY OF THE INVENTION

According to the present invention there is provided a composite material comprising polypropylene reinforced with bamboo fibers.

Polypropylene is chosen as a resin matrix material because of its low price and favourable mechanical properties. It is a material that allows the novel composite materials to be readily formed into boards, rods, thin sheets. The novel composite materials have light weight, good weathering ability, good design and manufacturing flexibility, and medium strength, ie ideal for use in furniture and construction industries and the like.

To improve the bonding between the bamboo fibers and the polypropylene matrix the polypropylene is preferably maleated. Either s-MAPP or m-MAPP maleated polypropylenes may be used.

Preferably the bamboo fiber component may comprise between about 20% to about 60% by weight, but particularly preferred results may be achieved with a bamboo fiber weight fraction of about 50% to about 60%.

The composite materials have better properties with smaller bamboo fiber dimensions. Preferably the bamboo fibers have a maximum length less than about 2000 $\mu$m, and more preferably still less than 1000 $\mu$m.

BRIEF DESCRIPTION OF THE DRAWINGS

Some embodiments of the invention will now be described by way of example and with reference to the accompanying drawings, in which.

DETAILED DESCRIPTION OF PREFERRED EMBODIMENTS

Figure 1:
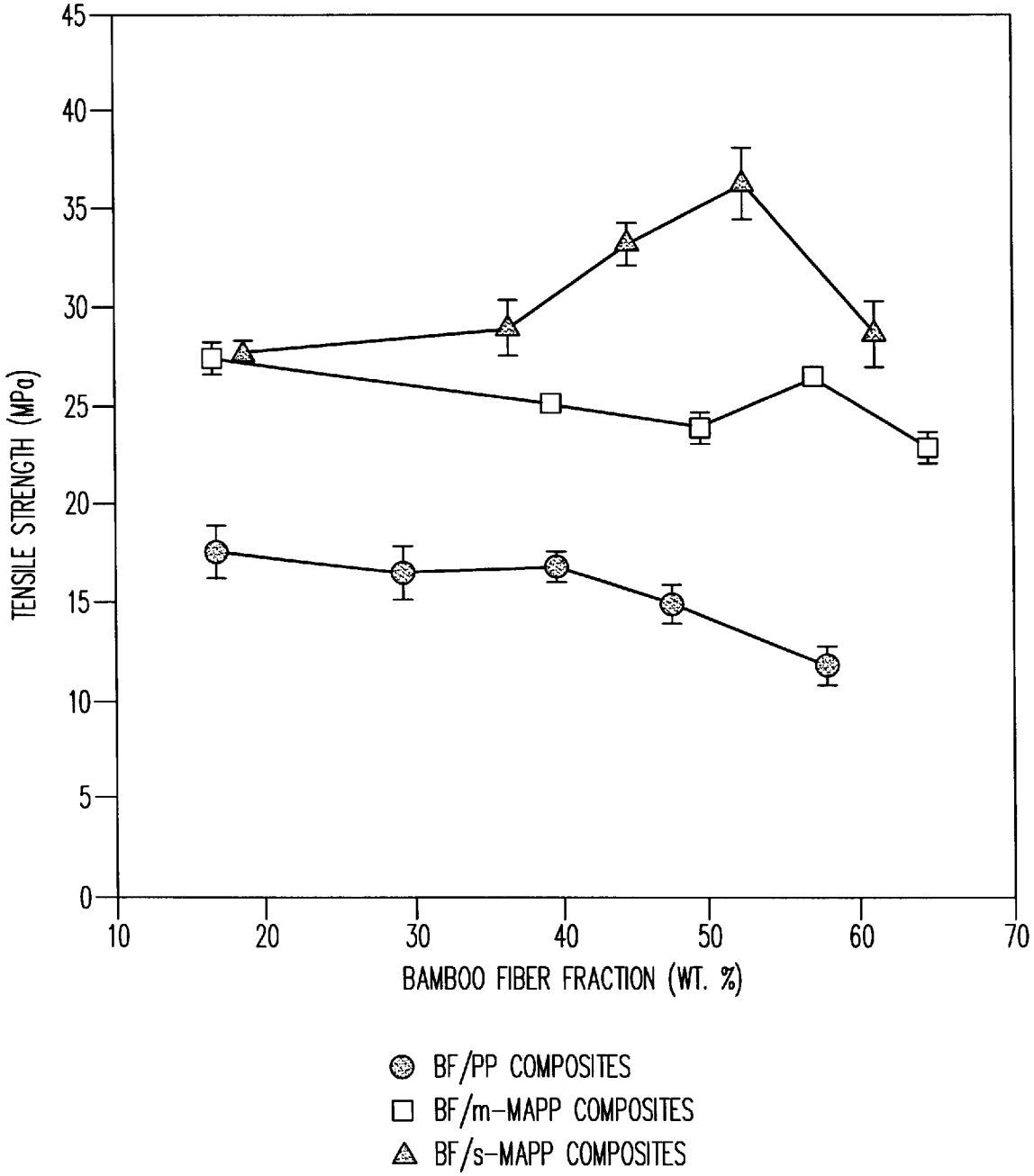
FIG. 1 shows the tensile strength of novel composite materials as a finction of bamboo fiber fraction.

Various samples were made of bamboo fiber reinforced composite polypropylene (PP) materials. The polypropylene used was Profax 6201 supplied by Himont Chemical Inc, this sample has a MFR=20 and a density of 0.920g/cm$^3$.

Samples were prepared using ordinary polypropylene, but in addition maleated polypropylene was prepared using maleic anhydride (MAH) as a reactive agent in order to promote the interaction between the PP and the bamboo fibers. This reaction can be carried out either in solvent as reaction medium or directly in a batch mixer.

A first type of maleated PP was prepared by solution surface grafting with benzoyl peroxide (BPO) as an initiator according to the method described in J. M. G. Martiner. J. Taranco, O. Laguna and E.P. Collar. *Inter. Polymer Processing IX*, 3, 246 (1994) and S. N. Sathe, G. S. S. Rao. and S. Devi, *J. Ap l. Polym. Sci.*, 53, 239 (1994). The content of MAH grafted onto the PP was ca. 1%. The sample thus obtained was designated as s-MAPP.

A second type of maleated PP was prepared by directly reactive mixing PP with MAH and a peroxide initiator according to the method described in C. W. Lin, *J. Mater. Sci., Lett.*, 12, 612–614 (1993). The reaction of MAH with PP was conducted by loading PP powders into the mixing chamber of a Haake Plasticorder at 160° C. while maintaining the speed of the screws at 30rpm. After 3 minutes the PP was molten and dicumyl peroxide (DCP) was added for another 4 minutes. Finally, MAH was added for a further 3 minutes mixing. The sample thus obtained was designated as m-MAPP.

The bamboo used in the preparation of the samples belonged to the species *Bambussa paravariabilis* which is grown abundantly in Asia. Bamboo clump were chopped into small chips with a roller machine and then bamboo fibers were prepared by breaking the bamboo materials in a Toshiba MX-301 high speed laboratory blender. The bamboo fiber thus obtained was then dried at 80° C. in a vacuum oven for 48 hours and was separated with a 500 $\mu$m sieve.

The composite materials were prepared by using a Haake Plasticorder. The polymer and the bamboo fiber were directly added into the mixing chamber, the composite samples were prepared at 180° C. and were further pressed at 180° C. into sheets of various thicknesses.

The tensile and impact properties of the various samples were then evaluated using several standard techniques.

Tensile tests were performed with a Universal Testing machine (UTM), Sintecch 10/D tensile tester, USA, and followed ASTM method D639-90. Tensile specimens of bamboo, polypropylene and bamboo fiber reinforced composites were machined in dumb-bell shape following the suggested dimensions of ASTM D639-90 specimen Type I. Five specimens for each sample were tested. The width and thickness of the narrow section for each specimen were measured with an electronic digital caliper before testing commenced. The standard testing conditions were: tensile speed; 3.00 mm/min: load limit HI: 50 KN; extensometer 25.00 mm, 50% extension.

Impact strength was measured by means of a Charpy impact test performed with a CEAST pendulum impact tester. The testing method was consistent with ISO method 179-1982(E). Notched specimens of composites were prepared following the dimensions of ISO 179-1982 type 2A. The notch was cut in the middle of the specimen with a CEAST notching machine. Fifteen specimens for each sample were tested and an 0.5 J pendulum was used to break the specimens.

After testing the crack width of each broken specimen was measured with an electronic digital caliper and then the Charpy impact strength was obtained from dividing the impact energy by the cross-sectional area. The unit of impact strength is KJ/m$^2$. The average impact strength for each sample was calculated from that of the group of the specimens.

Table I shows the tensile modulus, tensile strength and impact strength of five samples of BF/PP composite materials, five samples of BF/m-MAPP, and five samples of BF/s-MAPP composite materials with the bamboo fiber composition of the samples being varied. The results shown in Table I are shown graphically in FIGS. 1 to 3.

TABLE I

Summary of the effect of bamboo faction on the mechanical properties of BPRP composites

| Materials | Composition (wt. % BF) | Tensile Modulus (CoV)[a], [GPa] | Tensile Strength (CoV)[a], [MPa] | Impact Strength (CoV)[a], [KJ/m$^2$] |
|---|---|---|---|---|
| BF/PP Composites | 17 | 2.8(±0.3) | 17.5(±1.4) | 2.9(±0.5) |
| | 29 | 2.7(±0.4) | 16.5(±1.3) | 3.0(±0.5) |
| | 39 | 2.9(±0.4) | 16.9(±0.7) | 3.4(±0.4) |
| | 48 | 3.4(±0.4) | 15.0(±1.0) | 3.7(±0.4) |
| | 58 | 2.9(±0.2) | 11.8(±1.5) | 3.8(±0.5) |

TABLE I-continued

Summary of the effect of bamboo faction on the mechanical properties of BPRP composites

| Materials | Composition (wt. % BF) | Tensile Modulus (CoV)[a], [GPa] | Tensile Strength (CoV)[a], [MPa] | Impact Strength (CoV)[a], [KJ/m$^2$] |
|---|---|---|---|---|
| BF/m-MAPP Composites | 17 | 2.6(±0.1) | 27.4(±0.8) | 2.3(±0.4) |
| | 39 | 3.5(±0.9) | 25.2(±0.7) | 2.4(±0.4) |
| | 50 | 5.0(±0.8) | 24(±0.7) | 2.7(±0.3) |
| | 57 | 4.6(±0.4) | 26.6(±0.6) | 2.4(±0.4) |
| | 65 | 4.9(±0.2) | 23(±0.8) | 3.2(±0.4) |
| BF/s-MAPP Composites | 19 | 2.6(±0.3) | 27.7(±0.6) | 2.58(±0.5) |
| | 36 | 3.3(±0.1) | 29.0(±1.4) | 3.65(±0.5) |
| | 45 | 3.9(±0.5) | 33.3(±1.1) | 3.9(±0.6) |
| | 52 | 4.2(±0.5) | 36.4(±11.8) | 4.2(±0.6) |
| | 61 | 4.8(±0.8) | 28.8(±1.7) | 4.3(±0.5) |

[a]CoV: Coeficient of Variance

FIG. 1 shows the tensile strength of various novel composite samples as a function of the bamboo fiber fraction expressed as a weight percentage. The solid circles represent BF/PP composites, the open squares represent BF/m-MAPP composites and the solid triangles represent BF/s-MAPP composites. The figure shows that the maleated composite materials have significantly higher tensile strength. The difference between the s-MAPP and m-MAPP composites is not great at low bamboo fiber fractions, but the BF/s-MAPP composite materials show a marked increase in tensile strength at between about 40% to 60% bamboo fiber fraction peaking around 50%. The BF/m-MAPP composites show a smaller rise in tensile strength at between about 55% to 60% bamboo fiber fraction.

Figure 2:
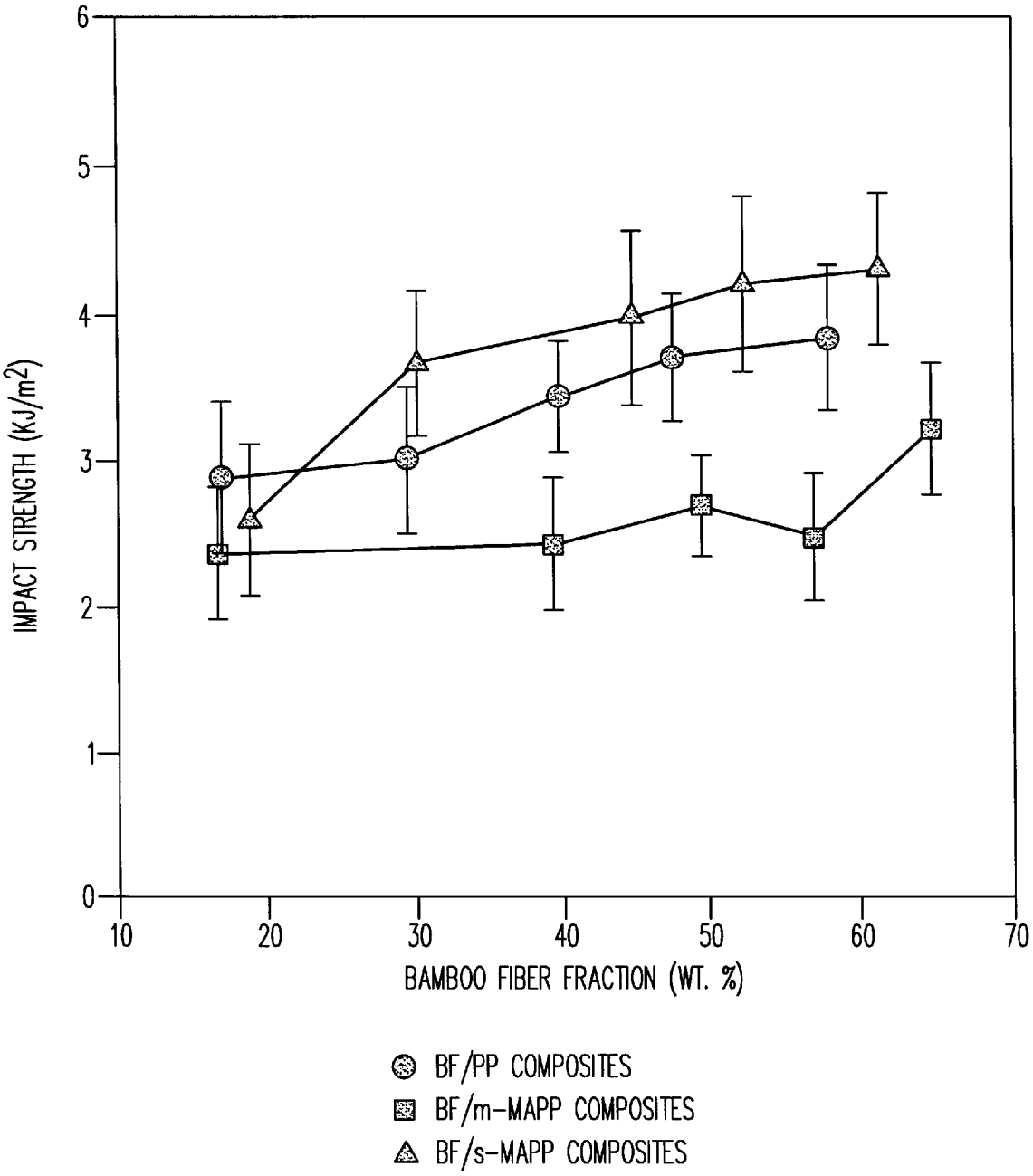
FIG. 2 shows the impact strength of novel composite materials as a function of bamboo fiber fraction.

FIG. 2 shows the impact strength for various novel composite materials. The squares correspond to BF/m-MAPP composites, the circles to BF/PP composites and the triangles to BF/s-MAPP composites. All three curves show a similar gradual increase in impact strength with bamboo fiber fraction, though the BF/m-MAPP composites show relatively reduced performance in comparison with the BF/s-MAPP samples.

Figure 3:
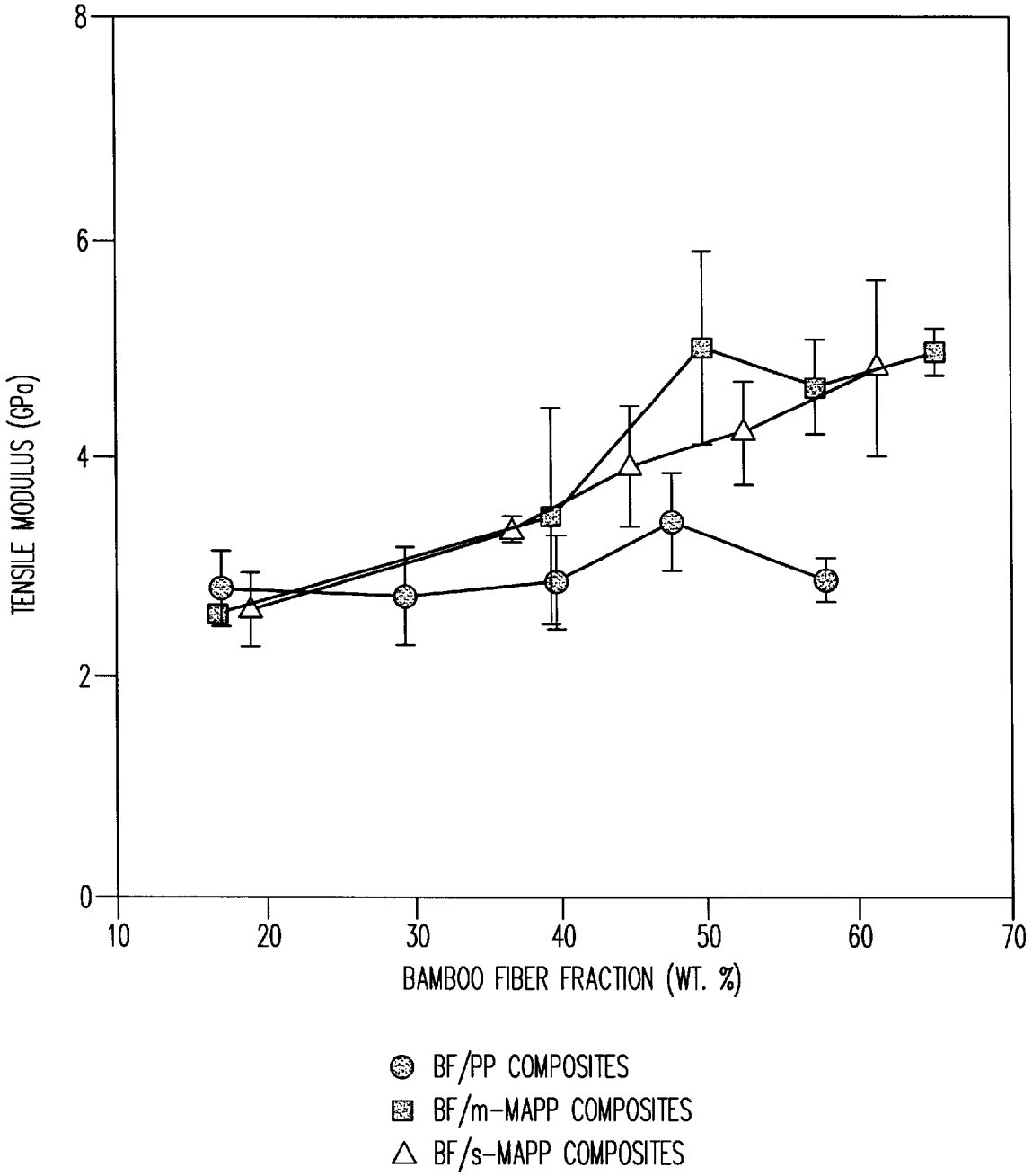
FIG. 3 shows the tensile modulus of novel composite materials as a function of bamboo fiber fraction.

FIG. 3 shows the effect of bamboo fiber fraction on tensile modulus. Solid circles represent BF/PP composites, solid squares represent BF/m-MAPP composites, and open triangles represent BF/s-MAPP composites. The m-MAPP and s-MAPP composite materials show generally increasing tensile modulus with increasing bamboo fiber fraction and the BF/m-MAPP samples show a sharp peak in tensile modulus at around 50% bamboo fiber fraction.

Table II shows the results obtained for measurements of the tensile modulus, tensile strength and impact strength for four samples of BF/PP composite materials and four samples of BF/s-MAPP materials, with the bamboo fiber size varying between the samples.

TABLE II

Effect of fiber size on the mechanical properties of BPRP composites (50 wt. % BF)

| Sample | Fiber size ($\mu$m) | Tensile Modulus (CoV)[a] [GPa] | Tensile Strength (CoV)[a] [MPa] | Impact Strength (CoV)[a] [KJ/m$^2$] |
|---|---|---|---|---|
| BP/PP Composites | <500 | 2.7(±0.3) | 15.3(±0.4) | 2.8(±0.4) |
| | 500–850 | 2.2(±0.3) | 12.6(±0.4) | 2.8(±0.2) |
| | 850–1000 | 2.3(±0.1) | 11.6(±0.7) | 3.3(±0.4) |

TABLE II-continued

Effect of fiber size on the mechanical properties of BPRP composites (50 wt. % BF)

| Sample | Fiber size (μm) | Tensile Modulus (CoV)[a] [GPa] | Tensile Strength (CoV)[a] [MPa] | Impact Strength (CoV)[a] [KJ/m$^2$] |
|---|---|---|---|---|
| | 1000–2000 | 1.9(±0.2) | 8.7(±0.4) | 2.2(±0.4) |
| BF/s-MAPP | <500 | 4.5(±0.4) | 39.4(±1) | 3.4(±0.4) |
| Composites | 500–850 | 3.2(±0.1) | 34.0(±0.7) | 3.2(±0.3) |
| | 850–1000 | 3.1(±0.5) | 31.2(±1.7) | 3.2(±0.7) |
| | 1000–2000 | 2.5(±0.2) | 28.0(±1.8) | 2.9(±0.6) |

Note:
[a]CoV — Coefficient of Variance

Figure 4:
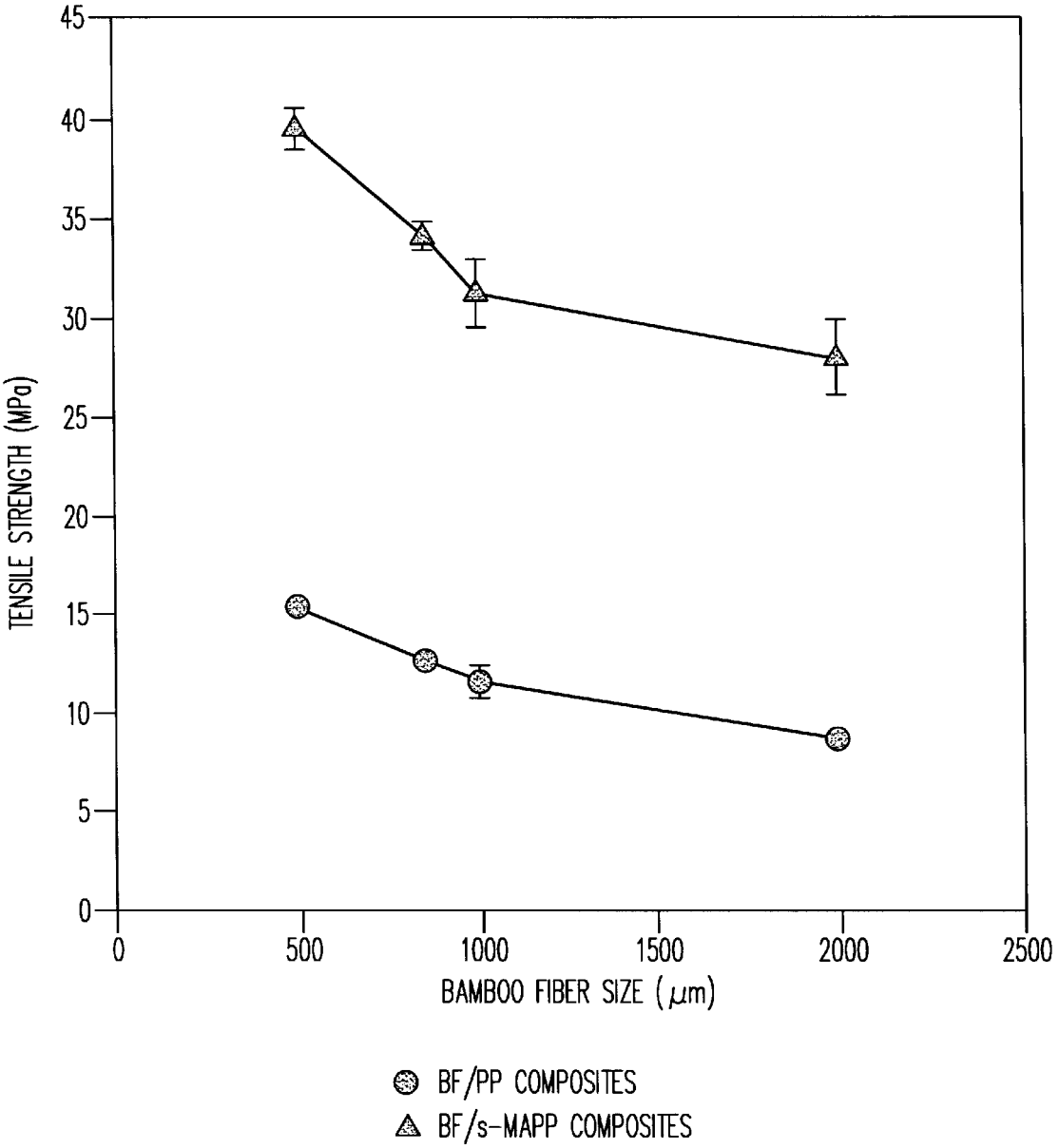
FIG. 4 shows the tensile strength of novel composite materials as a function of bamboo fiber size.

FIG. 4 illustrates the effect of bamboo fiber size on the tensile strength of samples of BF/PP composites (solid circles) and on BF/s-MAPP composites (solid triangles). It will be seen that there is an increase in tensile strength with lower bamboo fiber size, with the increase being particularly marked at fiber sizes of less than 1000 μm and being more marked still for BF/s-MAPP composites than for non-maleated BF/PP composite materials.

Figure 5:
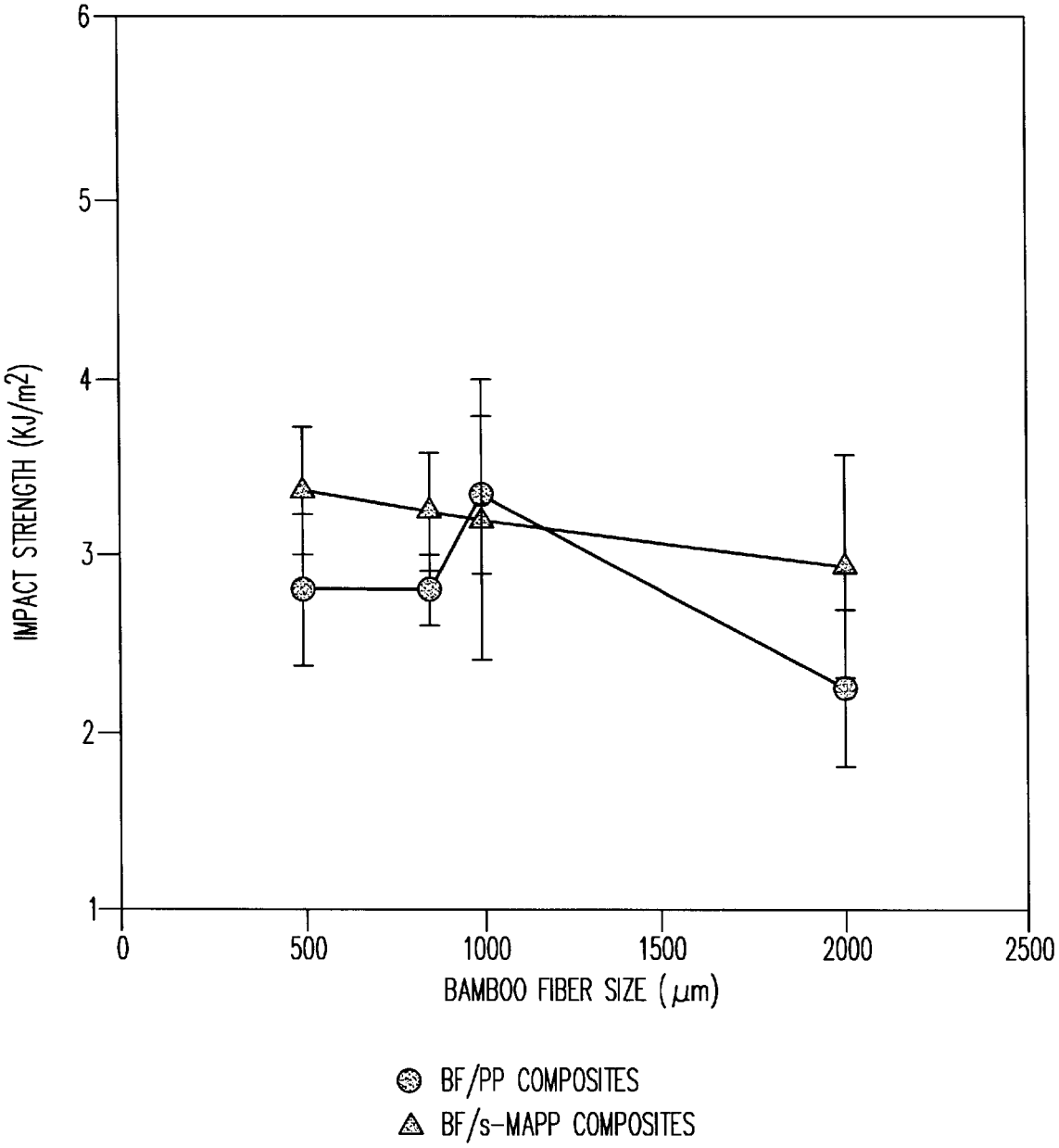
FIG. 5 shows the impact strength of novel composite materials as a function of bamboo fiber size.

FIG. 5 is a plot similar to FIG. 4 but showing impact strength. Here the effect of reduced fiber size is less marked but there is still a tendency of increasing impact strength with decreasing fiber size.

Figure 6:
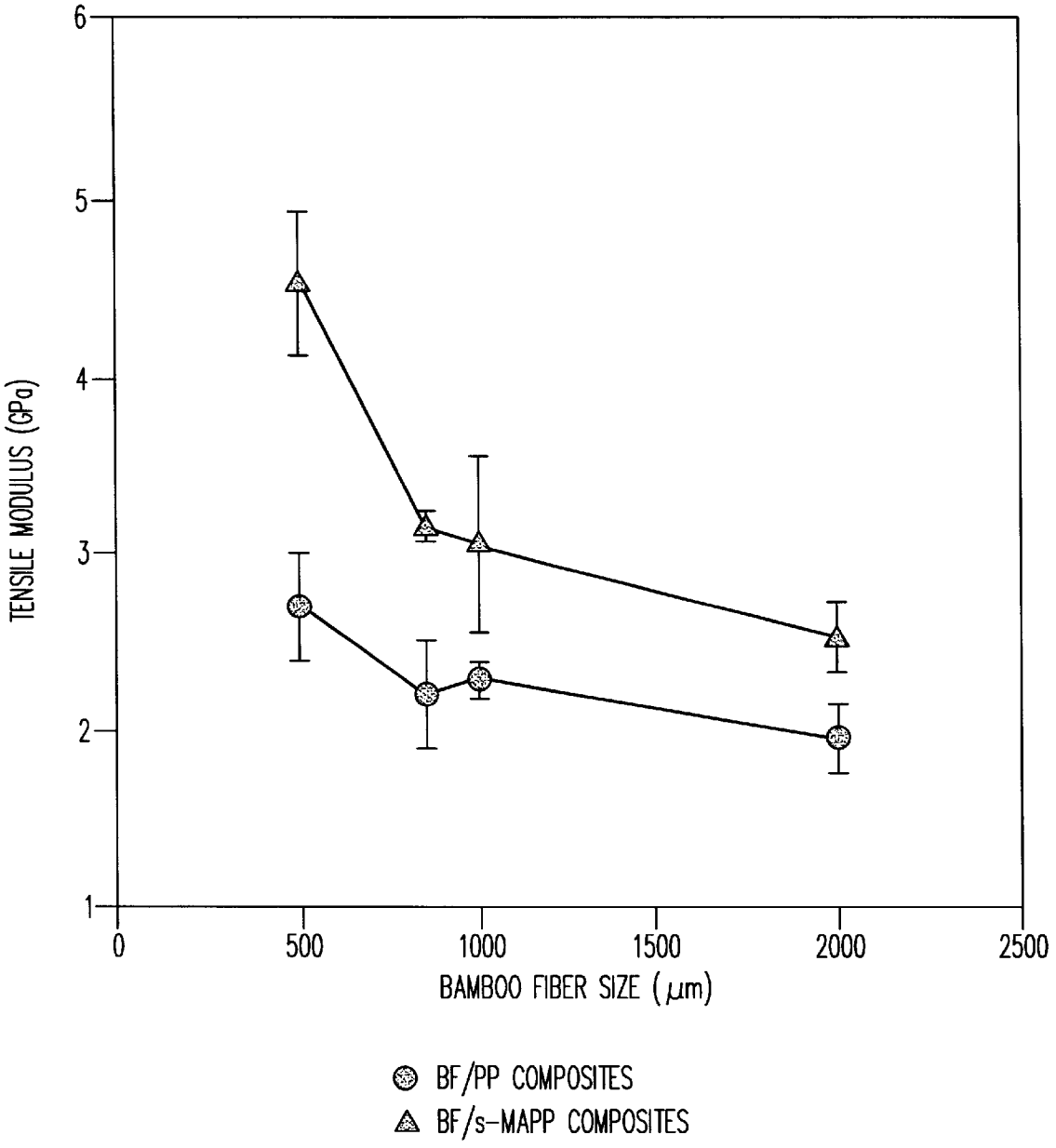
FIG. 6 shows the tensile modulus of novel composite materials as a function of bamboo fiber size.

FIG. 6 is a plot similar to FIG. 4 but in respect of tensile modulus. Again there is a general increase in tensile modulus with decreasing bamboo fiber size which becomes more significant at a fiber size of less than 1000 μm and more significant still for BF/s-MAPP composite materials.

The polypropylene component of the composite material need not be exclusively pure PP alone of maleated PP alone, but may instead be a mixture. Table III shows the effect of increasing the degree of maleation, however, and shows that as the MAH content increases there is little difference in the tensile modulus or the impact strength, but there is a significant increase in the tensile strength as the degree of maleation increases.

TABLE III

Effect of MAH content on the mechanical properties of BFRP composites (50 wt. % BF)

| s-MAPP/PP [w/w] | % MAH in Composites[a] [wt. %] | Tensil Modulus (CoV)[b] [GPa] | Tensile Strength (CoV)[b] [MPa] | Impact Strength (CoV)[b] [KJ/m$^2$] |
|---|---|---|---|---|
| 0/50 | 0.0 | 2.8(±0.2) | 14.4(±1.0) | 3.2(±0.6) |
| 8/42 | 0.038 | 3.2(±0.5) | 19.0(±2.1) | 3.6(±0.7) |
| 16/34 | 0.077 | 4.2(±0.5) | 24.5(±2.1) | 3.5(±0.7) |
| 24/26 | 0.11 | 4.1(±0.4) | 30.1(±1.2) | 3.7(±0.7) |
| 32/18 | 0.15 | 4.4(±0.5) | 30.5(±1.3) | 3.3(±0.7) |
| 41/9 | 0.19 | 4.3(±0.6) | 31.1(±1.6) | 3.8(±0.6) |
| 50/0 | 0.24 | 4.2(0.5) | 32.4(±1.2) | 3.6(±0.5) |

Note:
[a]The degree of grafting of s-MAPP is 0.47 wt. % MAH.
[b]CoV — Coefficient of Variance Table IV is a comparison of the mechanical properties of bamboo fiber reinforced polypropylene composite materials with commerical wood pulp composite materials.

TABLE IV

Comparison of the mechanical properties of BFRP composites with the commercial wood pulp composites

| Sample | Tensile Modulus (CoV)[a][GPa] | Elonga-tion (%) | Tensile Modulus (CoV)[a][MPa] | Impact Strength (CoV)[a][KJ/m$^2$] |
|---|---|---|---|---|
| BP/PP Composite (50 wt. % BF) | 2.6(±0.3) | 1.2 | 15.4(±0.5) | 3.4(±0.3) |
| BF/m-MAPP Composite (50 wt. % BF) | 3.8(±0.3) | 0.7 | 25.6(±0.7) | 2.7(±0.3) |
| BF/s-MAPP Composite (50 wt. % BF) | 4.1(±0.2) | 1.4 | 33.8(±1.2) | 3.7(±0.3) |
| Commercial Wood Pulp Composite | 1.9(±0.2) | 0.4 | 10.8(±0.8) | 2.8(±0.4) |

Note:
[a]CoV — Coefficient of Variance

Figure 7:
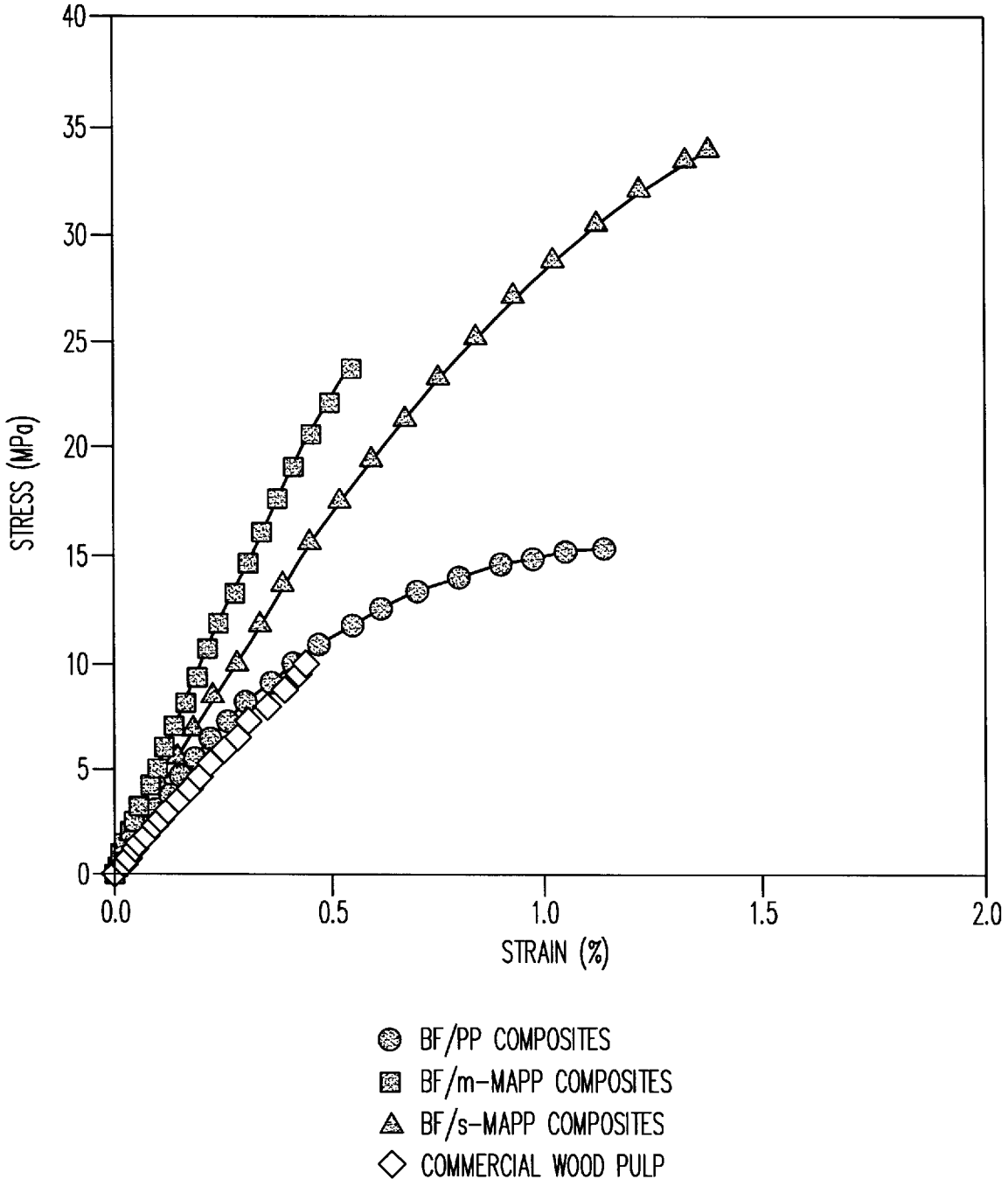
FIG. 7 shows stress-strain curves of various novel composite materials.

FIG. 7 shows the stress-strain curves for novel composites of BF/PP, BF/s-MAPP, BF/m-MAPP and—by way of comparison—for commercial wood pulp. From FIG. 7 it can be seen that the novel composite materials have stress-strain properties at the very least equal to commercial wood pulp and in the case of the maleated s-MAPP and m-MAPP samples significantly superior.

By way of comparison with the prior art—though not taking into account other factors such as cost—Table V compares the mechanical properties of various bamboo fiber reinforced composite materials in accordance with the present invention and in accordance with the prior art disclosures of F. G. Shin et al and U. C. Jindal et al discussed above.

TABLE V

Mechanical properties of several BFR plastic composites

| Materials[a,b,c,] | Detail | Tensile Modulus [GPa] | Tensile Strength [MPa] |
|---|---|---|---|
| [a]BSF/PP | 50 wt. % BSF, f.s. < 2 mm | 2.3–2.9 | 14.4–16.4 |
| [b]BSF/m-MAPP | 50 wt. % BSF, f.s. < 2 mm | 3.5–4.0 | 24.6–26.6 |
| [a]BSF/s-MAPP | 50 wt. % BSF, f.s. < 2 mm | 3.8–4.2 | 32.0–36.0 |
| [b]BSP/PS | 50 wt. % BSF, | 5.71 | 8.4 |
| [b]BSF/UF(dried) | 25 wt. % BSF, | 5.0–5.8 | 18–23 |
| [b]BSF/EP | 50 wt. % BSF, f.l. 3–6 cm | 3.7–8.2 | 19–49 |
| [b]BLF/EP | [0/90],3–7 ply, 40 wt. % BLF, f.l. 20 cm | 45–76 | 178–243 |
| [c]BLF/EP | [0] single layer, 50 wt. % BLF, f.l. 40 cm | — | 170–180 |

Note:
B — Bamboo, SF — Short Fiber, LF — Long Fiber, EP — Epoxy, UF — Urea Formaldehyde, f. s. — Fiber Size, f.l. — Fiber Length, [0/90] — Bidirection 0°/90°, [0] — Unidirection 0°.
Materials:
[a]refer to this work;
[b]refer to F. G. Shin et al;
[c]refer to U. C. Jindal et al Thus it will be seen that the present invention provides novel composite materials having properties similar to or better than conventional materials and which are suitable for use in a wide range of applications.

We claim:

1. A composite material comprising a polypropylene matrix including maleated polypropylene. said maleated polypropylene comprising at least 16% of said composite material by weight, said matrix being reinforced with bamboo fibers comprising between about 20% to about 60% of said composite material by weight.

2. A material as claimed in claim 1 wherein said bamboo fiber fraction is between about 50% to about 60% by weight.

3. A material as claimed in claim 1 wherein said bamboo fibers have a maximum length of less than 2000 $\mu$m.

4. A material as claimed in claim 3 wherein said bamboo fibers have a maximum length of less than 1000 $\mu$m.

5. A method for preparing a wood substitute composite material, comprising the steps of:

grafting maleic anhydride onto polypropylene to prepare maleated polypropylene;

combining said polypropylene, said maleated polypropylene and bamboo fibers to form a mixture comprising at least 16% by weight of said maleated polypropylene and between about 20% and about 60% by weight of bamboo fibers; and hot pressing said mixture to form a wood substitute material.

6. The method of claim 5 wherein said mixture comprises between about 50% and about 60% by weight of bamboo fibers.

7. The method of claim 5 wherein said bamboo fibers have a maximum length less than 2000 $\mu$m.

8. The method of claim 7 wherein said maximum length is less than 1000 $\mu$m.

* * * * *

UNITED STATES PATENT AND TRADEMARK OFFICE

CERTIFICATE OF CORRECTION

PATENT NO. : 5,882,745

DATED : March 16, 1999

INVENTOR(S) : Yongli MI et al.

It is certified that error appears in the above-indentified patent and that said Letters Patent is hereby corrected as shown below:

In Section [75], please change "Saikung, China" to --Sai Kung, Hong Kong--.

In Section [73], please change "HongKong Univiersity" to –Hong Kong Unviersity--, in accordance with the PTOL-85B.

Signed and Sealed this

Nineteenth Day of October, 1999

*Attest:*

*Attesting Officer*

Q. TODD DICKINSON

*Acting Commissioner of Patents and Trademarks*

UNITED STATES PATENT AND TRADEMARK OFFICE

CERTIFICATE OF CORRECTION

PATENT NO. : 5,882,745

DATED : March 16, 1999

INVENTOR(S) : Yongli MI et al

It is certified that error appears in the above-identified patent and that said Letters Patent is hereby corrected as shown below:

In Section [75], correct the residence of the third inventor from "Hefei, China" to --Hefei, China--

Signed and Sealed this

Fourth Day of April, 2000

*Attest:*

Q. TODD DICKINSON

*Attesting Officer*

*Director of Patents and Trademarks*